United States Patent [19]

Craighead

[11] 4,204,470

[45] May 27, 1980

[54] INDICIA FORMING MULTIPLE DIE

[76] Inventor: James W. Craighead, 501 Dexter St., Denver, Colo. 80220

[21] Appl. No.: 938,392

[22] Filed: Aug. 31, 1978

[51] Int. Cl.[2] ..... B44B 5/02

[52] U.S. Cl. ..... 101/28; 425/395; 101/398

[58] Field of Search ..... 101/28-31, 101/370, 372, 373, 381, 391-393, 396-399; 69/2, 7.7; 425/394, 395, 398, 402

[56] References Cited

U.S. PATENT DOCUMENTS

| | | | |
|---|---|---|---|
| 87,588 | 3/1869 | Penney | 101/31 |
| 627,542 | 6/1899 | Stafford | 101/28 |
| 921,974 | 5/1909 | Ginsburg | 101/28 |
| 951,343 | 3/1910 | Simmang | 101/28 |
| 1,093,485 | 4/1914 | Scotford et al. | 101/373 X |
| 1,225,712 | 5/1917 | Haskins | 101/398 X |
| 1,850,856 | 3/1932 | Weindel | 101/28 X |
| 2,690,910 | 10/1954 | Tuck | 69/2 X |
| 3,122,095 | 2/1964 | Miller | 101/381 |

*Primary Examiner*—Edward M. Coven
*Attorney, Agent, or Firm*—Sheridan, Ross, Fields & McIntosh

[57] ABSTRACT

A device for forming decorative designs or other indicia on a malleable or deformable material. The device comprises a single, integral outer die having a pair of longitudinal grooves for extruding a bead or rim on the deformable material. The device further includes a series of independent inner die sections, releasably held within a passage in the outer die by means of bolts inserted through transverse openings in the outer die. Longitudinal outer surfaces or faces of the inner die sections include decorative patterns for extruding the designs or indicia on the material. The extrudable piece of material is positioned against the faces of the inner die sections and the grooves of the outer die. A pressurizing tool is then applied against the piece of material simultaneously forming the design patterns of the inner and outer dies on the malleable material.

10 Claims, 6 Drawing Figures

INDICIA FORMING MULTIPLE DIE

BACKGROUND OF THE INVENTION

1. Field of the Invention

This invention relates to an embossing device for extruding deformable materials and more particularly to independent, interchangeable inner die sections releasably contained within an outer die and where the outer die and inner die sections are arranged to simultaneously form decorative indicia on, preferably, nonmetallic materials such as leather goods.

2. Description of the Prior Art

A number of devices for imprinting indicia on materials have been developed. U.S. Pat. No. 1,083,278 to Gordon discloses a leather marker including two center die blocks and two detachable die blocks adjacently held on opposite, outward sides of the center dies. The end surfaces of the die blocks form adjacent numbers or letters when applied to leather material. U.S. Pat. No. 443,383 to Veit illustrates a series of separate dies contained within a die-stock. These dies are combined to form a particular design pattern. U.S. Pat. No. 1,827,550 to Williams discloses a stamping machine attachment, which may be used to impress initials on leather. The initial forming members are secured in the attachment by means of clamping jaws. Additionally, U.S. Pat. No. 2,740,352 to Kingsley shows an adapter for stamping machines which accomodates interchangeable type members. The type members are received within a type holder which in turn is received within a channel. These devices disclose the concept of interchangeable, indicia forming elements. However, these references do not show a device, including, a single, integral outer die and independent inner die sections, completely and releasably held within the outer die such that the longitudinal surfaces of the outer and inner die sections are capable of embossing malleable materials.

Heretofore, where it was desirable to form a name on a piece of leather, such as a leather belt, as well as a decorative design, it was necessary to include a blank space in the die so that the name could subsequently be imprinted on the belt. This procedure involved the individual and sequential positioning of the appropriate letters of the name over the blank space in the belt and pressing the letters into the belt to form the selected name. It is readily apparent that such a procedure can be quite time-consuming, since each letter must be placed separately and these letters must be placed after the decorative design has been molded into the belt. Also, the length of the blank space is determinative of the length of the word that may be inserted in the space and, therefore, it may be necessary to have several dies with varying blank spaces for accomodating different length words. The user, on the other hand, of the indicia forming multiple die disclosed herein may simultaneously form the decorative design and a name of any length because of the interchangeability of the inner die sections.

SUMMARY OF THE INVENTION

In accordance with this invention, a device is provided to form decorative design patterns on malleable materials. The device has an outer die and a series of interchangeable inner die sections completely contained within the outer die. The outer die and inner die sections have preselected design patterns, which are to be imparted to the deformable material when it is placed against the design patterns of the dies. A pressurizing tool is subsequently pressed against the material thereby forming the die patterns on the material. Fastening means releasably hold the inner die sections within the outer die so that proper alignment of the dies is assured thereby preventing decorative flaws in the extruded material.

More particularly, the invention comprises a single, integral outer die having a generally rectangular shape with a pair of parallel spaced, longitudinal side walls and an end wall perpendicularly connected therebetween at each end of the side walls. A channel is centrally positioned between the side walls and extends between the end walls. The channel includes a generally rectangular shaped passage extending the complete length of the outer die. Outwardly adjacent on each side of the passage is a longitudinally extending groove, while beneath the passage is a longitudinal slot which also extends between the end walls of the outer die. In addition, the outer die has a plurality of spaced transverse openings generally perpendicular to the side walls of the outer die and which extend from one of the side walls for a portion of the distance between the side walls.

Positioned in the passage of the outer die is an inner die, preferably, comprising a number of independent die sections. These die sections may be conveniently arranged in the passage to provide the desired decorative pattern. Each inner die section has an outer surface having decorative indicia for embossing a malleable material placed thereover. To maintain proper alignment of the inner die sections within the outer die, a plurality of fasteners, such as bolts or screws, may be inserted into the transverse openings of the outer die through the outer die slot to compress the outer die about the inner die sections. Conversely, the inner die sections may be forceably fitted in the passage wherein additional inward movement of the bolt separates the outer and inner die sections. This adjustment is facilitated since some resilience is present in the outer die because of the longitudinal slot formed therein.

Subsequent to the placement of the inner die within the outer die, a piece of malleable material is positioned against the outer surface of the inner die. The outer edges of this material extend over the grooves of the outer die. A force, such as that resulting from a hydraulic press, is applied against the malleable material. Consequently, the grooves of the outer die form a longitudinal bead or rim on the longitudinal edges of the material and the inner die sections extrude a decorative design on the portion of the deformable material between the grooves.

From the foregoing description, it is apparent that various design patterns can be quickly and efficiently formed on malleable materials, preferably, leather goods, such as leather belts. In particular, when it is desirable to incorporate a name along with decorative indicia on a leather belt, the inner die sections may be appropriately arranged to include the name and the design. The application of pressure against the belt forms the design and name thereon in a simple, single operation.

Additional advantages of this invention will be readily apparent from the description which follows, taken in conjunction with the accompanying drawings.

DESCRIPTION OF THE PREFERRED EMBODIMENT

Figures 1, 2, 3:
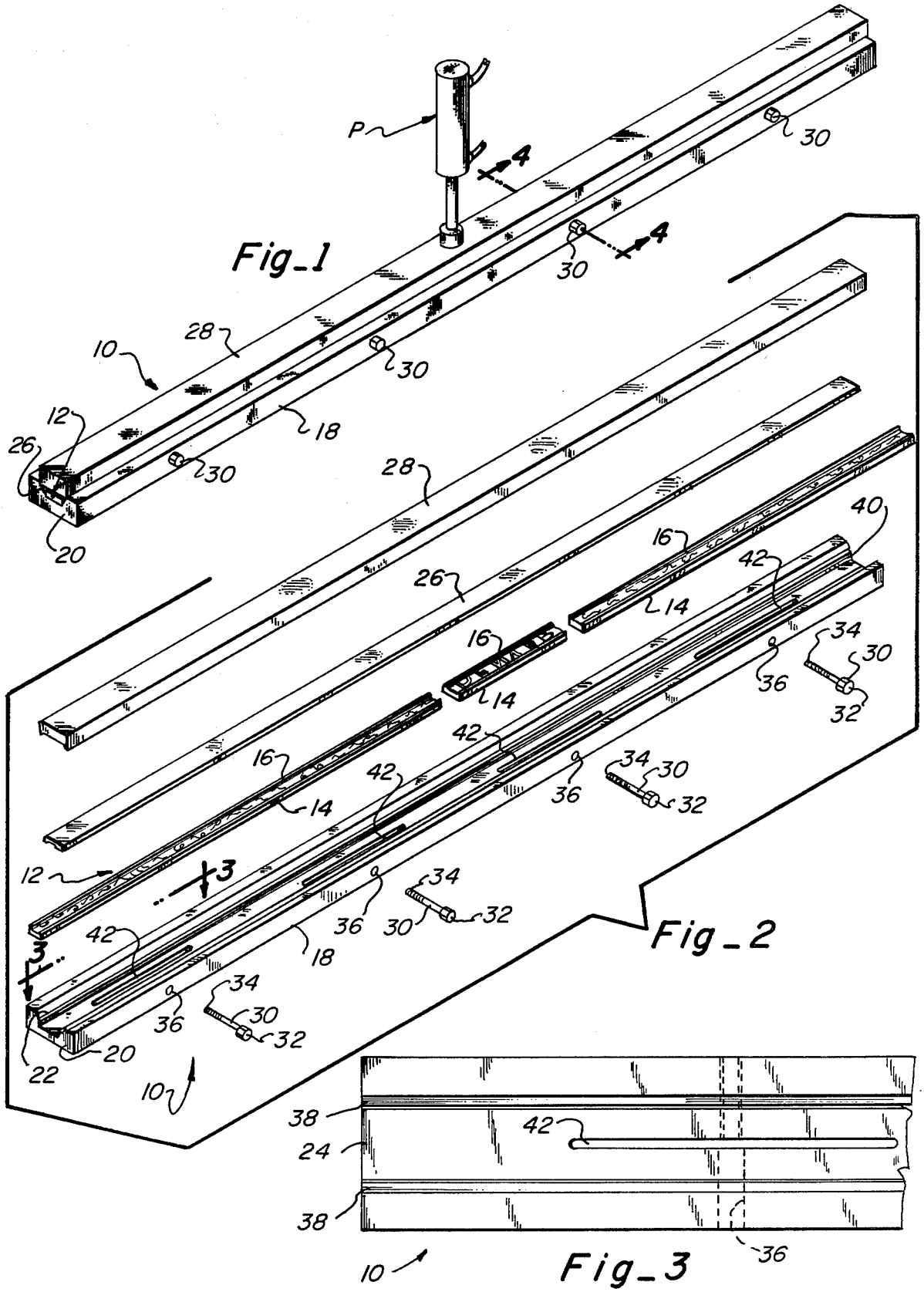
FIG. 1 is a perspective view of the multiple die in working relation with the pressurizing tool which overlies a piece of malleable material.
FIG. 2 is an exploded view of the parts of FIG. 1.
FIG. 3 is an enlarged fragmentary plan view, taken along line 3—3 of FIG. 2, showing a transverse opening and a longitudinal slot.

In accordance with this invention, a multiple die is provided in working relation with an appropriate pressurizing tool, such as a hydraulic operated press P, as illustrated in FIG. 1, to form decorative design patterns or other indicia on a malleable piece of material 26. As best seen in FIG. 2, the multiple die includes a first or outer die 10 and a second or inner die 12, preferably, comprising a number of independent, interchangeable die sections 14. Outer die 10 includes a pair of parallel, spaced, longitudinally extensive side walls 18 connected together at the ends thereof by end walls 20 which perpendicularly between the side walls 18. Channel 22 is centrally disposed within outer die 10 and includes passage or recess 24 which is rectangularly shaped and is of a depth to readily receive and removably contain inner die sections 14. The inner die sections 14 have raised faces or outer surfaces 16 which can be arranged in a longitudinal series in passage 22 and are used to extrude a piece of malleable material 26 by the force of pressing arm 28 against malleable piece 26 after it has been placed over the multiple die. A number of fasteners, such as bolts 30, can be inserted through transverse openings 36 in the outer die 10 to secure inner die sections 14 within passage 24, as will be explained later in more detail.

As seen in FIG. 3, the outer die 10 additionally includes a pair of longitudinally extensive, arcuate-shaped grooves 38 formed inwardly of outer die 10. One groove is laterally, outwardly adjacent each longitudinal side surface 40 of rectangular passage 24. Grooves 38 extend the complete length of outer die 10 through end walls 20 and have a depression substantially less than passage 22. Longitudinally extensive slots 42 are also formed in outer die 10. Slots 42 are centrally positioned in the outer die 10, extending the full length thereof, and are contiguous with passage 24. Slots 42 are shown in FIGS. 2 and 3 as a plurality of discontinuous, individual openings in outer die 10 wherein the number of separate slots corresponds to the numer of bolts 30. Alternatively, a single, continuous slot may be formed in outer die 10 rather than the separate slot arrangement depicted in FIGS. 2 and 3. In addition, FIG. 3 illustrates transverse opening 36 which is generally perpendicular to side walls 18 and is conveniently threaded for at least a portion of the opening 36 to receive and hold bolt 30.

Figure 4:
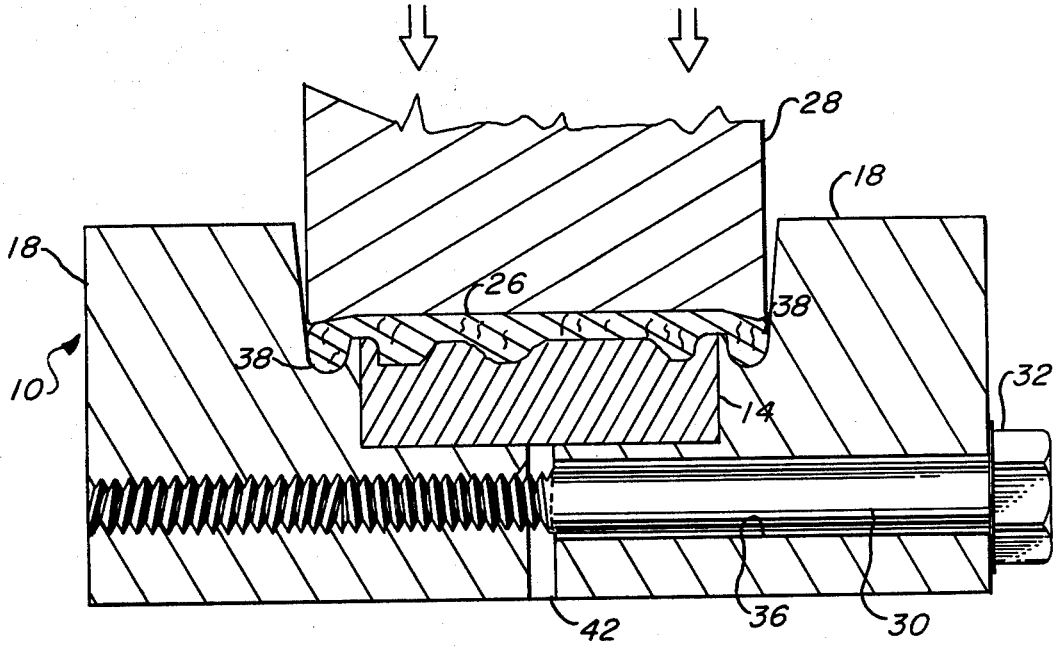
FIG. 4 is a greatly enlarged vertical section; taken along line 4—4 of FIG. 1, showing further details of the pressurizing tool in working relation with the multiple die.

FIG. 4 exemplifies the operation of the indicia forming multiple die. Inner die section 14 having extruded face 16 is placed in passage 24 of outer die 10. After placement of inner die section 14 in passage 24, threaded bolt 30 is inserted into transverse opening 36. Inward movement of bolt 30 continues until bolt head 32 meets side wall 18 and outer die 10 compresses about inner die section 14 thereby tightly clamping the inner die section 14 within passage 24. This locking operation assures that inner die section 14 placed in series in outer die 10 will not separate along the lateral line where a first inner die section meets a second inner die section. If such a separation or sliding apart of inner die sections 14 occurred, malleable piece of material 26 would flow between the cracks formed in the inner die sections thereby resulting in the creation of flaws in the material to be embossed whenever press P is applied to the malleable material 26.

After tightening inner die section 14 within outer die 10, malleable or deformable material 26 is placed over inner die section 14 and grooves 38 of outer die 10. Pressing arm 28 is subsequently moved to contiguously overlie malleable piece 26 in channel 22. As the arrows of FIG. 4 indicate, pressing arm 28 is moved against malleable material 26. The pressing action of arm 28 extrudes the malleable material 26 thereby imparting the decorative design pattern of the inner die faces 16 and the grooves 38 of the outer die 10 to the malleable material 26.

Typically, a leather belt is the piece of malleable material 26 and inner die section faces 16 include an extruded floral design. In addition to the floral design die sections, a die section having a letter design, such as a name, is included. Since the inner die sections are easily interchanged, the die section having the name may conveniently be inserted in series with the floral design section. Consequently, after placement of the belt over the inner die section faces 16 and the grooves 38 of the outer die 10, the stamping action of pressing arm 28 simultaneously embosses a longitudinal bead or rim on each of the longitudinal edges of the belt. These beads are formed by the outer die grooves 38. The portion of the leather belt intermediate the beads receives the floral design and name due to the embossing of the belt by the inner die faces 16.

Figure 5:
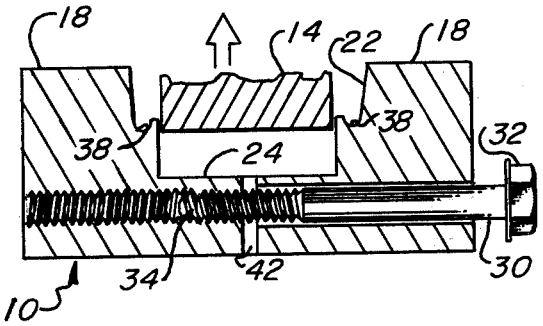
FIG. 5 is a slightly enlarged vertical section, similar to FIG. 4, showing the removal of the inner die from the outer die after releasing the fastening means.

The removal of the inner die section 14 from the outer die passage 24 is depicted in FIG. 5. Bolt 30 is turned in an outwardly direction away from outer die 10, releasing the compressive forces exerted by the outer die 10 on the inner die section 14. As the arrow of FIG. 5 indicates, inner die section 14 can then be vertically lifted from the passage of the outer die. The outer die 10 is again ready to receive a series of inner die sections 14 having a preselected design pattern.

Figure 6:
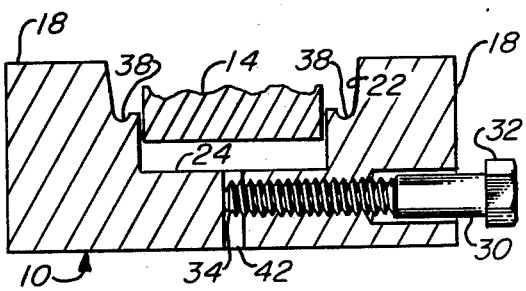
FIG. 6 is a slightly enlarged vertical section, similar to FIG. 5, showing another embodiment of the fastening means for removal of the inner die from the outer die.

As seen in FIG. 6, an alternative embodiment for securing and releasing the inner die section 14 within the outer die passage 24 is illustrated. Rather than using inward movement of bolt 30 to compress outer die 10 about inner die section 14, inner die section 14 is forceably fitted within the outer die passage 24. This gripping engagement of the inner die section 14 within outer die 10 may be accomplished by narrowing the outer die passage 24. Consequently, inward movement of bolt 30 through transverse opening 36 forces the outer die side walls 18 apart, thereby allowing insertion of inner die section 14 in outer die 10. This separating or forcing apart of outer die side walls 18 is accomplished by the force of end portion 34 of bolt 30 as it bears against outer die side wall 18 after end portion 34 has passed through slot 42. After insertion of the inner die section 14, bolt 30 is moved outwardly away from outer die 10 so that the force exerted by the bolt 30 against the outer die side wall 18 is released. The resiliency of the outer die 10 provided by slots 42 enables the outer die 10 to collapse about the inner die section 14 and securely hold it in the outer die passage 24.

From the foregoing, the advantages of this invention are readily apparent. An embossing device has been provided which is of relatively simple construction, yet very efficient in operation. The interchangeable inner die sections have a preselected design pattern and are easily inserted into and removed from the outer die. The application of a pressurizing tool after inserting a piece of malleable material in the multiple die simultaneously forms a decorative design pattern as well as a longitudinal bead on the material.

The invention has been described with particular reference to a plurality of embodiments thereof, but it will be understood that variations and modifications can be effected within the spirit and scope of the invention.

What is claimed is:

1. A device for receiving a pressurizing tool and forming decorative indicia on malleable material, which is positioned between said device and the pressurizing tool, said device comprising;

a first die having transverse openings and a surface with a first preselected pattern for forming a portion of the decorative indicia on the malleable material;

a recess within a portion of said surface for receiving a second die;

a second die receivable within said recess of said first die and having a surface with a second preselected pattern completely contained within said recess, wherein said second pattern lies in substantially the same plane as said first pattern to simultaneously deform the malleable material and form decorative indicia thereon upon application of the pressurized tool;

a slot formed in said first die only, said slot being generally perpendicular to said transverse openings while being vertically adjacent said recess to provide resilience to said first die and facilitate the insertion and releasing of said second die within said recess; and fastening means positioned in said transverse openings and said slot to hold said second die in said first die and position said second preselected pattern adjacent said first preselected pattern to minimize decorative flaws in the deformed material.

2. The device, as claimed in claim 1, wherein;

the preselected pattern of said first die includes at least one longitudinal groove on the malleable material, said groove being located adjacent said recess of said first die.

3. A device for receiving a pressurizing tool and forming decorative indicia on malleable material, which is positioned between said device and the pressurizing tool, said device comprising:

a single, integral first die including transverse openings formed therein and a passage and a first longitudinal surface having a first preselected pattern adjacent said passage wherein said first pattern deforms the malleable material to form decorative indicia thereon upon application of the pressurizing tool;

a second die, completely and releasably held within said first die passage, and including a longitudinal surface having a second preselected pattern, wherein said second pattern simultaneously deforms the malleable material with said first pattern upon application of the pressurizing tool;

a slot formed in said first die only, said slot being generally perpendicular to said transverse openings while being vertically adjacent said recess to provide resilience to said first die and facilitate the insertion and releasing of said second die within said passage; and means positioned in said transverse openings and said slot for fastening said second die within the said first die to assure proper alignment of said second die within said first die to position said second preselected pattern adjacent said first preselected pattern to minimize decorative flaws in the deformed material.

4. The device, as claimed in claim 3, wherein:

said second die includes a plurality of independent die sections, interchangeably arrangable to vary the second preselected pattern to be applied to the malleable material.

5. The device, as claimed in claim 4, wherein said first die further includes:

first and second longitudinal side walls; and a pair of longitudinal grooves which form said first pattern on the malleable material, said grooves positioned outwardly adjacent said first die passage.

6. The device, as claimed in claim 5, wherein said fastening means includes:

a plurality of bolts, one of said bolts inserted in each of said transverse openings and through said slot; and means for securing said bolts in said transverse openings so that said resilient first die is compressed about said second die to releasably hold said second die therein whenever the decorative indicia is formed on the malleable material.

7. The device, as claimed in claim 5, wherein said fastening means includes:

a plurality of bolts, each having a head and an end portion wherein each of said bolts is inserted in one of said transverse openings and extends from the first side wall through said slot of said first die so that said bolt end portion is contiguous with said second side wall so that additional movement of said bolt in the direction of said second side wall forces outwardly said second side wall thereby releasing said second die section fixedly held in said first die passage.

8. The device, as claimed in claim 6 or 7, wherein:

said slot is plurality of slots and the number of said slots corresponds to the number of said bolts.

9. A device for receiving a pressurizing tool and forming decorative indicia on malleable material, which is positioned between said device and the pressurizing tool, said device comprising:

a single, integral first die having:

a pair of parallel spaced, longitudinally extending side walls;

a pair of end walls, each end wall generally perpendicular to said pair of side walls and connected therebetween;

a longitudinal channel, centrally disposed between said side walls and extending through said end walls and wherein said channel includes a generally rectangular passage;

a pair of grooves, said grooves outwardly adjacent said first die passage for forming a longitudinal rim on the malleable material;

a centrally disposed slot adjacent said passage to provide an opening in and resilience to said integral first die;

a plurality of transverse openings generally perpendicular to said slot and extending from one of said side walls of said first die through said slot;

a plurality of independent, interchangeable die sections releasably held in said passage of said first die having an embossed outer surface to form decorative indicia on the malleable material whenever the pressurizing tool is moved against the material which is positioned contiguously with said second die sections and said grooves of said first die; and a plurality of bolts wherein one of said bolts is inserted in each of said transverse openings of said first die through said first die slot and is fixedly held in said transverse opening so that additional movement of said bolt forces outwardly one of said side walls of said outer die to release said second die sections held in said passage of said first die.

10. A device for receiving a pressurizing tool and forming decorative indicia on malleable material, which is positioned between said device and the pressurizing tool, said device comprising:

a first die having a first wall and a second wall with a plurality of transverse openings formed through said first wall, said first die having a surface with a first preselected pattern for forming a portion of the decorative indicia on the malleable material;

a recess formed within a portion of said first die surface;

a second die receivable within said recess of said first die and having a surface with a second preselected pattern completely contained within said recess, wherein said second pattern lies in substantially the same plane as said first pattern to simultaneously deform the malleable material and form decorative indicia thereon upon application of the pressurizing tool; and moveable fastening means having a first end and being inserted in said transverse openings, said first end of said fastening means being contiguous with said second wall so that upon additional movement of said first end in the direction of said second wall forces outwardly said second wall thereby releasing said second die held in said recess.

* * * * *